United States Patent [19]

Grabbe et al.

[11] Patent Number: 4,602,833

[45] Date of Patent: Jul. 29, 1986

[54] CLOSED LOOP CONNECTOR

[75] Inventors: Dimitry G. Grabbe, Middletown, Pa.; Charles W. Herb, Winston-Salem, N.C.; Iosif Korsunsky, Harrisburg, Pa.

[73] Assignee: AMP Incorporated, Harrisburg, Pa.

[21] Appl. No.: 684,233

[22] Filed: Dec. 20, 1984

[51] Int. Cl.[4] ..... H01R 31/08

[52] U.S. Cl. ..... 339/19; 339/42; 339/49 R

[58] Field of Search ..... 339/19, 222, 183, 42, 339/143 R, 47

[56] References Cited

U.S. PATENT DOCUMENTS

| | | | |
|---|---|---|---|
| 2,639,341 | 5/1953 | Truax | 339/19 |
| 3,491,326 | 1/1970 | Pfister et al. | 339/19 |
| 3,845,450 | 10/1974 | Cole et al. | 339/42 |
| 3,903,385 | 9/1975 | Moyer et al. | 339/19 |
| 4,230,386 | 10/1980 | Farnworth et al. | 339/42 |
| 4,460,234 | 7/1984 | Bogese | 339/222 |
| 4,493,526 | 1/1985 | Masuda | 339/183 |
| 4,501,459 | 2/1985 | Chandler et al. | 339/222 |

*Primary Examiner*—Gil Weidenfeld
*Assistant Examiner*—David L. Pirlot
*Attorney, Agent, or Firm*—F. Brice Faller

[57] ABSTRACT

Hermaphroditic electrical connector comprises a dielectric housing having terminals therein with resilient contact tongues and shunt means fixed to a dielectric carrier which moves relative to housing in response to mating with a like connector as tongues engage respective like tongues. The shunt means engage portions of the terminals remote from the contact tongues to electrically connect alternate terminals when the connector is in an unmated condition, the shunt means being in unmated relation with the terminals when the connector is mated.

8 Claims, 12 Drawing Figures

CLOSED LOOP CONNECTOR

The present invention relates to a hermaphroditic electrical connector having means for connecting selected terminals therein when in unmated condition.

There is disclosed in U.S. Pat. No. 4,449,778 an electrical connector of the type comprising an insulating housing having a plurality of conductive terminals and electrical shunt means therein, the terminals having resilient contact tongues which engage like tongues in a like connector, the shunt means being in shunted relation with the terminals when the connector is in an unmated condition, the shunt means being in unshunted relation with the terminals when the connector is in mating engagement with a complementary connector.

The connector disclosed in U.S. Pat. No. 4,449,778 employs shunt bars which are fixed in the housing and have lugs which make contact with resilient contact tongues of the terminals when the connector is in an unmated condition. When mated, the contact tongues engage like contact tongues in a complementary hermaphroditic connector and thus deform the contact tongues away from the lugs on the shunt bars. This arrangement suffers the disadvantage that, in order to have adequate contact pressure between the shunt means and the contact tongues of the terminals, the tongues must be substantially deformed. The additional deformation imposed by like terminals during mating must be quite small,. else the tongues be deflected beyond their elastic limit and suffer decreased contact pressure with the shunt means on their return.

SUMMARY OF THE INVENTION

The present invention is characterized in that the shunt means are fixed to a dielectric carrier which moves relative to the housing in response to mating with a complementary connector. The shunt means engage portions of the terminals remote from the contact tongues, whereby the shunt means moves relative to the housing and out of shunted relation with the terminal portions. Thus the contact forces on the tongues and the portions engaged by the shunt means may be independently determined, the transfer and shunt functions being separate and independent of each other.

According to a feature of the invention, the portions of the terminals engaged by the shunt means as well as the shunt means are isolated from the mating face of the connector, in a fully enclosed portion of the connector, whereby foreign matter cannot interfere with shunting. The contact lugs are disposed freely toward the portions of the terminals engaged thereby at an oblique angle, whereby a wiping action occurs during engagement and disengagement with the complementary hermaphroditic connector.

The connector also features a strain relief housing molded in two parts connected by a hinge, the halves being hinged through 180 degrees to engage the cable jacket and a ground ferrule on the braid. A locking ferrule is screwed onto the housing to achieve a good grip on the cable, only one half of the housing being threaded, whereby alignment problems are eliminated. A square flange thereon is inserted through a like-profiled hole in the connector, then turned through 45 degrees before finishing assembly of the connector to lock the strain relief in place. The braided cable shield is dressed back over a split metal ferrule and forced through a circular aperture in the connector shield, whereby the braid is forced radially against the connector shield. The braid is thus under controlled force engagement on its entire perimeter, thus assuring a stable low resistance contact and complete shielding.

BRIEF DESCRIPTION OF THE DRAWINGS

FIG. 5 is a partial cross section of unmated connectors.

FIG. 6 is a partial cross section of mated connectors.

FIG. 8 is a perspective of the split metal ferrule.

FIG. 8A is an end view of the ferrule uncompressed.

FIG. 8B is an end view of the ferrule compressed.

DETAILED DESCRIPTION OF THE PREFERRED EMBODIMENT

Figure 1:
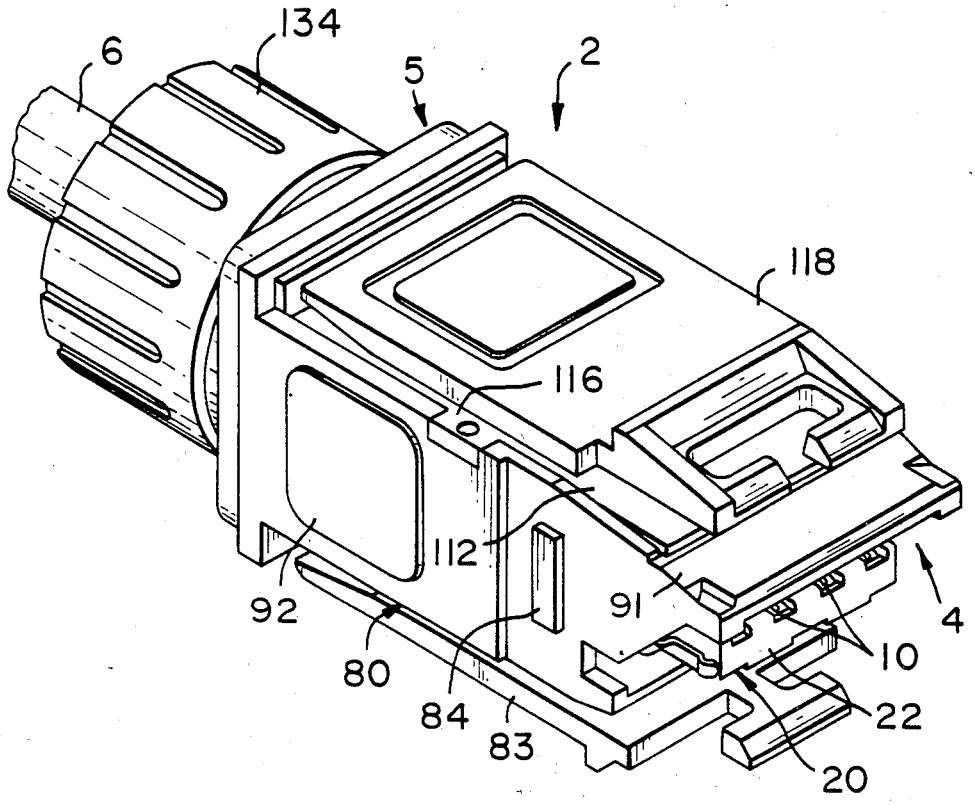
FIG. 1 is a perspective of the assembled connector.

Referring to FIG. 1, the connector 2 of the present invention comprises a mating face 4 where it engages the mating face of a like hermaphroditic connector and an opposed cable receiving face 5 where cable 6 enters for termination. The external profile of the connector is quite similar to that of the connector disclosed in U.S. Pat. No. 4,449,778 and is defined by a lower cover part 80 having a latch 83, and an upper cover part 110 having a complementary latch 118. The housing 20 having terminal support platform 22 to which terminals 10 are fixed is visible in mating face 4 below hood 91 which bridges sidewalls 84 of the lower cover part 80. Plugs 92 in sidewalls cover alternate cable entry points in sidewalls 84.

Figure 2:
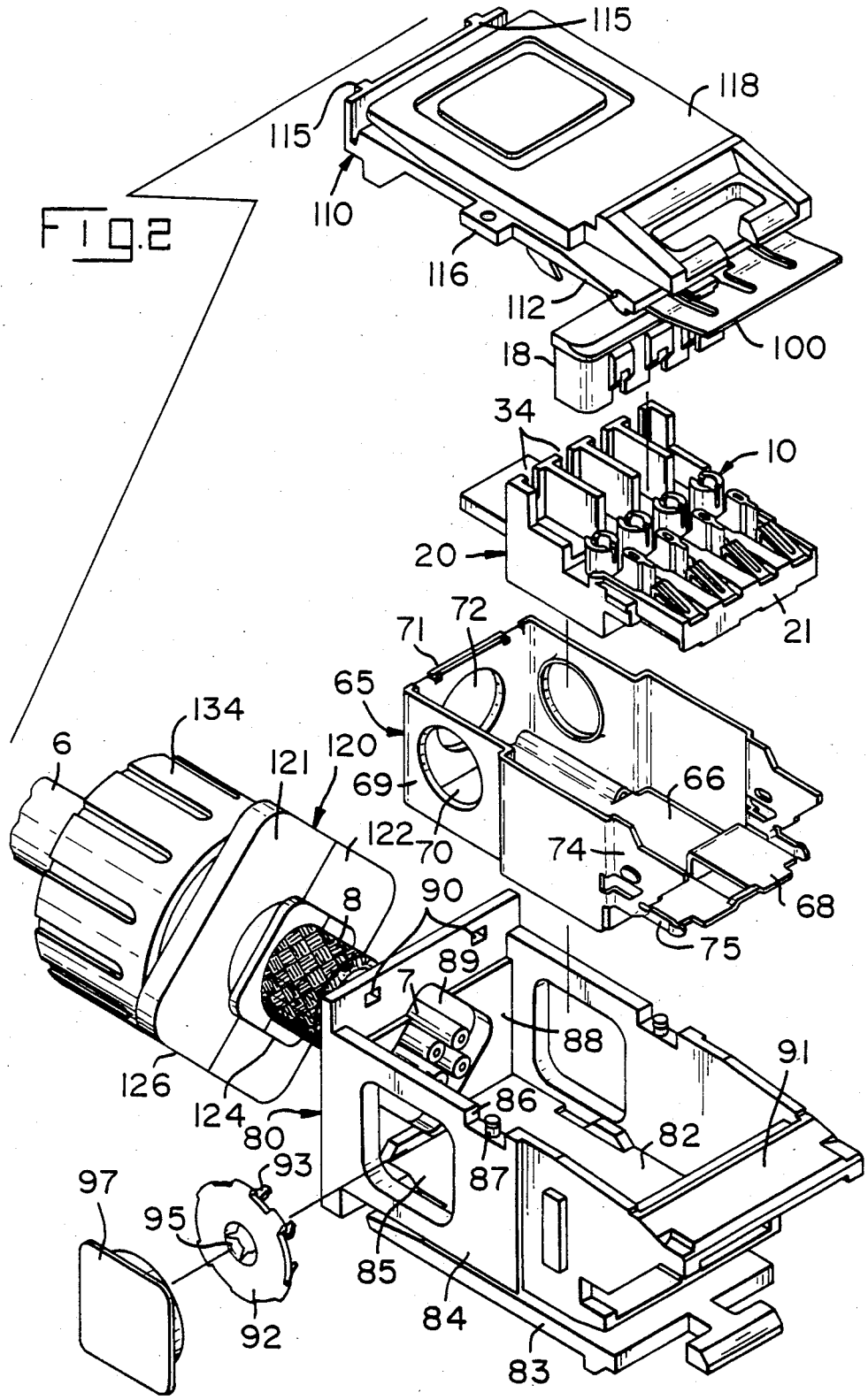
FIG. 2 is a partially exploded perspective of the connector.

FIG. 2 shows the terminal housing 20 with terminals 10 assembled thereto and stuffer 18 poised thereabove. Lower shield 65 is stamped and formed metal comprising a base panel 66 having forward contact portion 68 formed integrally therewith, which portion 68 makes contact with a like portion in a like hermaphroditic connector when mated. Sidewalls 69, having circular apertures 70 therein, are formed upward from base panel 66 and have wings 74 and resilient tongues 75 formed forwardly thereof for mating with like tongues and wings in a like connector, whereby shielding continuity is achieved. See U.S. patent application Ser. No. 666,573, where a similar arrangement is disclosed. Rearwall 71 is also formed from sidewalls 69 and includes a circular aperture 72. The shield 65 is shaped to rest in lower cover part 80, which part is molded in plastic and includes a base panel 82 and sidewalls 84 having square apertures 85 therein and recesses 86 with posts 87 in the tops thereof. Rearwall 88 likewise has a square aperture 89 therein angled at 45 degrees as shown and two small apertures 90 which serve a latching function with upper cover part 110. A hood 91 bridges the forward ends of sidewalls 84 and likewise serves to latch cover part 110 as will be described.

Referring still to FIG. 2, the connector is assembled by snapping the shield plugs 92 into apertures 70. The plugs 92 are retained by resilient outer fingers 93. Each plug 92 also has an inner aperture surrounded by resilient inner fingers 95 which engage a post 98 (FIG. 4) in the center of cover plug 97. The lower shield 65 is nested in lower cover part 80, the housing 20 with terminals 10 is nested in the lower shield 65, and the cable 6 with strain relief 120 assembled thereto is inserted through apertures 89, 72. The strain relief 120 is molded in two halves 121, 122 which are hinged together on the cable 6 and an outer ferrule 134 is screwed thereto for retention. The braided shield 8 is folded back on a split metal ferrule 9 forward of an inside square flange 124 which is profiled to fit neatly through aperture 89 in the lower cover part; the braid 8 is received in aperture 72 and forced against shield 65 uniformly by the radially expansive force of the split ferrule, which will be described more fully in conjunction with FIG. 8. The strain relief 120 is then rotated through 45 degrees so that the side edges of outside square flange 126 are parallel to the edges of rearwall 88. Wires 7 are then dressed into channels 34 in the housing 20 and inserted into wire barrels 11 by stuffer 18. The upper cover 110 with upper shield 100 assembled thereto is then assembled to lower cover 80. A latch 113 (FIG. 3) on panel portion 112 of upper cover 110 is hooked under hood 91 and rear latches 115 snap into apertures 89 as side flanges 116 are received in recesses 86. The lower and upper covers 80, 110 have resiliently hinged latching members 83, 118 respectively which cooperate with like members on a mated connector for retention.

Figure 2A:
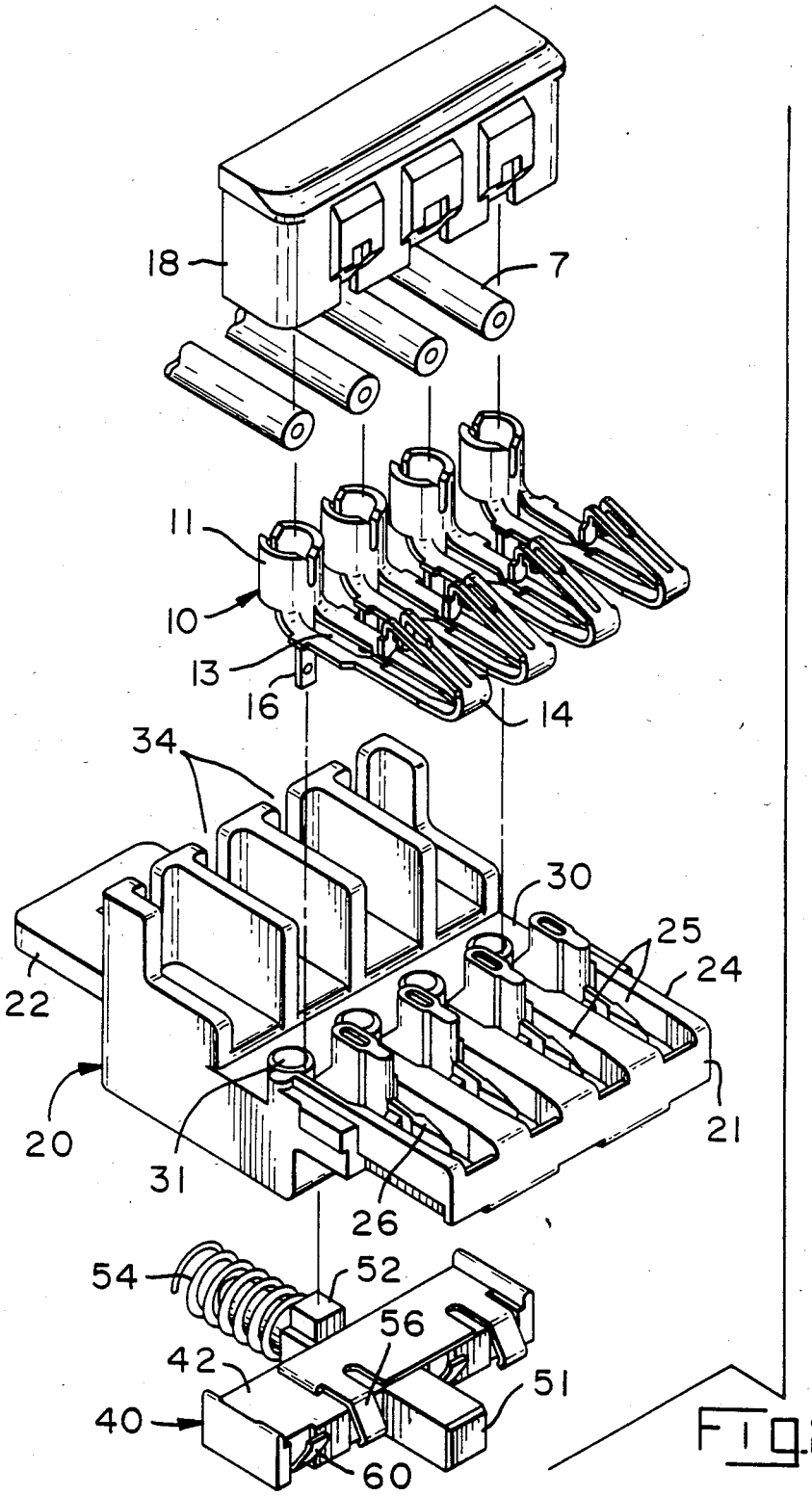
FIG. 2A is a perspective of the housing with terminals and shunt carrier exploded therefrom.
Figure 3:
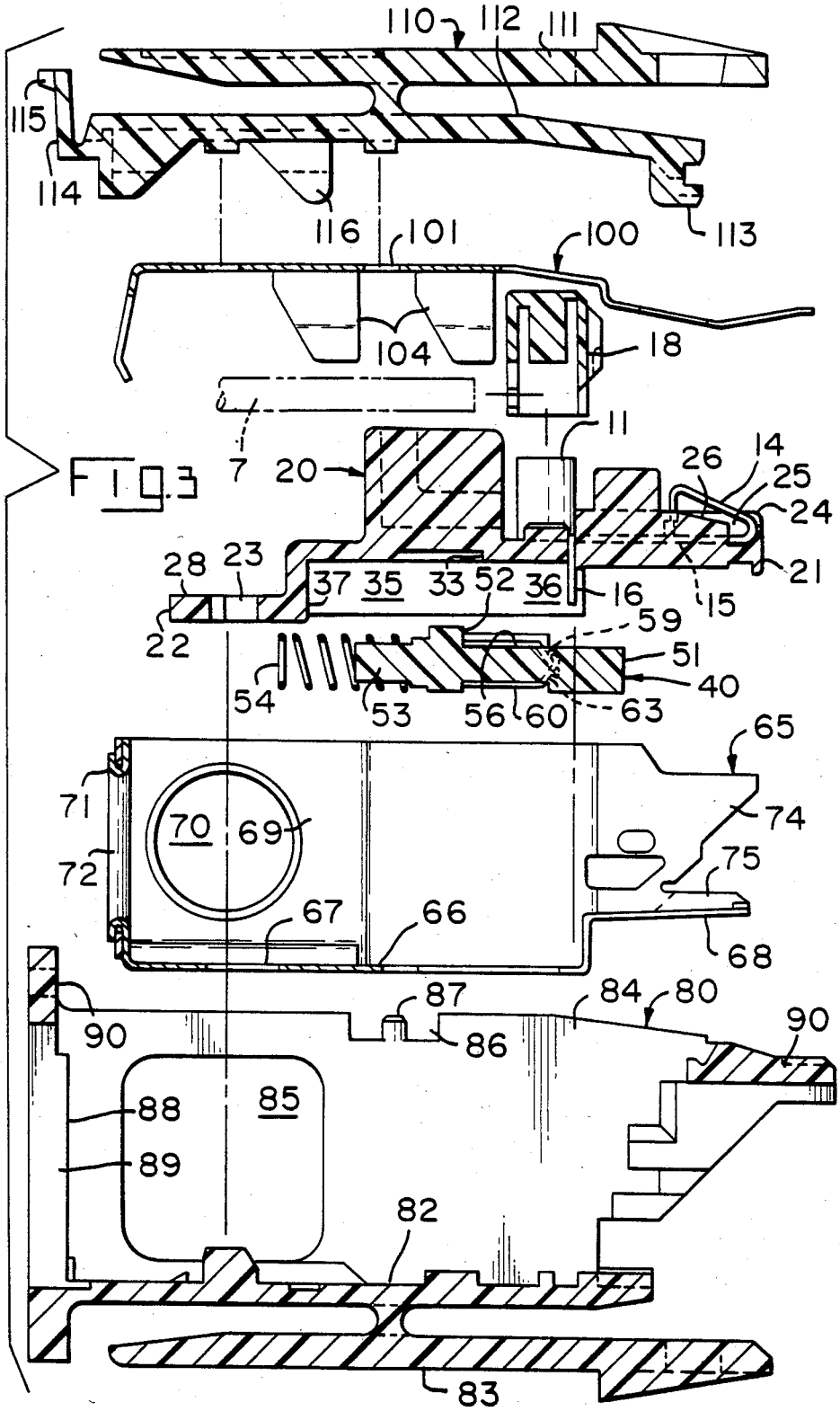
FIG. 3 is a fully exploded side sectional of the connector.

Referring to FIG. 2A, the housing 20 comprises a forward end 21, a rearward end 22, and a trough 30 lying therebetween. A terminal support platform 24 has channels 25 therein which extend from end 21 to trough 30, each channel 25 having upstanding therein a wedge-shaped stop 26 to which a respective terminal 10 is fixed. The terminals 10 each comprise a wire barrel 11, a base portion 12, and a resilient tongue 14 reversely bent from the base portion 12. A tail 16 is stamped from slot 13 in base portion 12. Barrels 11 are received on respective posts 31 in trough 30 while tails 16 extend through apertures 32 (FIG. 3). Wedges 26 are received in slots 13 in an interference fit and lie under tongues 14 to prevent overstress. After the terminals 10 are emplaced, wires 7 are received in wire channels 34 toward rear platform 28 and the wire ends are forced into respective barrels 11 with stuffer 18. Shunt assembly 40, comprising a carrier 42 having first shunt bar 56, a second shunt bar 60, and a coil spring 54, is shown poised for reception in the underside of the housing 20.

Figure 2B:
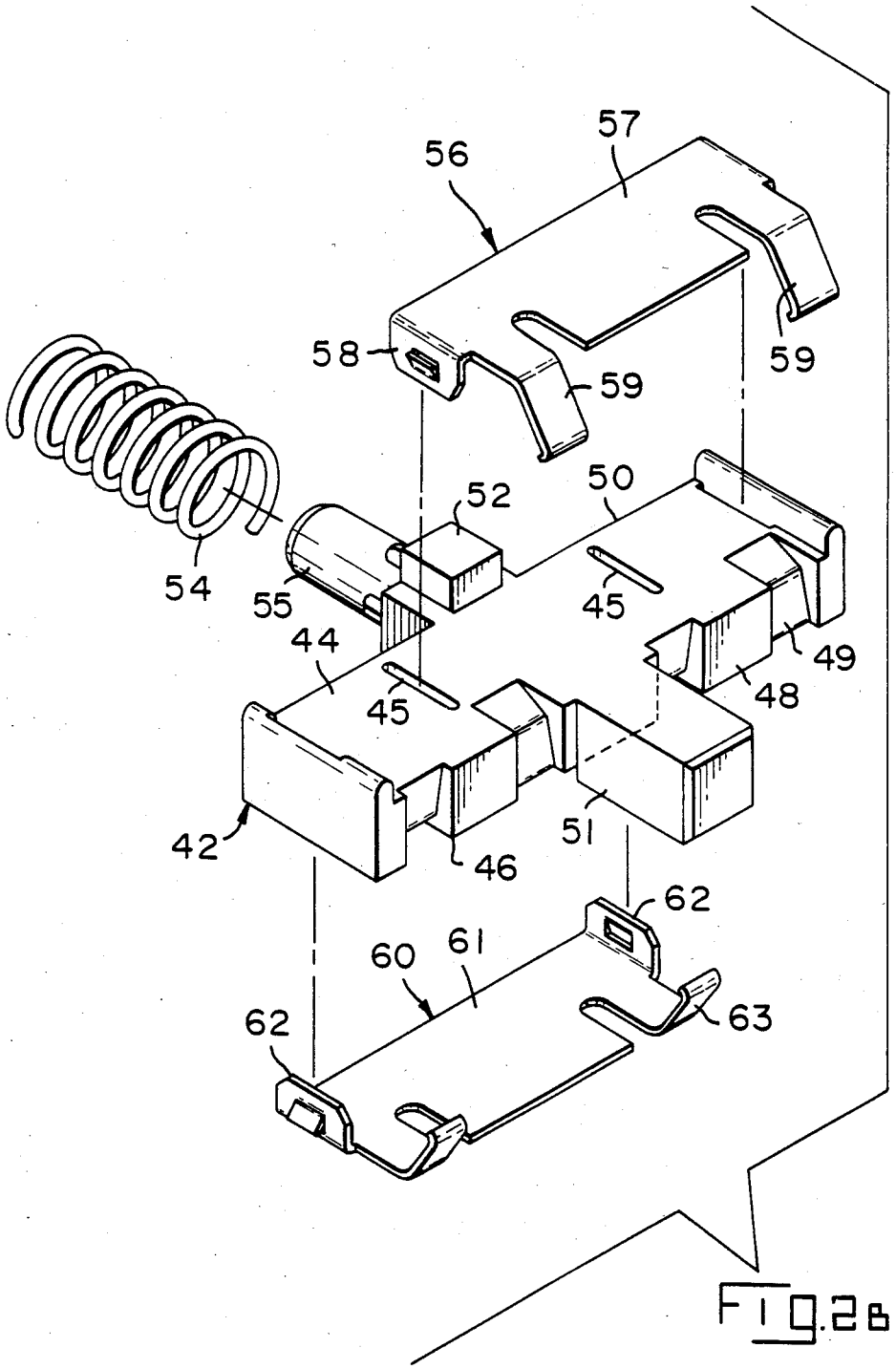
FIG. 2B is an exploded perspective of the shunt carrier.

Referring to FIG. 2B, carrier 42 has a top surface 44 with slots 45 therein, an opposed bottom surface 46 with similar slots, a forward face 48 with channels 49 therein and an actuator 51 extending centrally thereof, and an opposed rear face 50 having a post 53 extending rearwardly thereof and a guide 52 extending upwardly thereof. The first shunt bar 56 has a stamped bridge portion 57 with flanges 58 extending downwardly thereof for interference reception in slots 45 and resilient lugs 59 depending from the forward edge thereof which are aligned with alternate channels 49 in housing 42. The second shunt bar 60 likewise has a stamped bridge portion 61 with flanges 62 and resilient lugs 63 depending therefrom, and is received against bottom surface 46 with lugs 63 aligned with alternate channels 49. The lugs 59, 63 are only preformed before assembly to carrier 42, final forming being accomplished against channels 49 after assembling the shunt bars 56, 60 to the carrier 42.

FIG. 3 is an exploded section which shows the cooperation of all internal parts. The housing 20 has a chamber 35 having a forward wall 36 and a rearward wall 37 profiled in the bottom thereof; the shunt assembly is emplaced in chamber 35 so that spring 54 bears against rearwall 37 and resilient lugs 59, 63 bear against respective terminal tails 16, which in turn lie against forward wall 36 of chamber 35, actuator 51 protruding through a channel 29 at the forward end of the chamber. The guide 52 rides closely in a channel 33 to prevent cocking of the assembly 40 in operation. The lower shield 65 is fitted in lower cover 80 so that post 81 on base panel 82 is received through aperture 67, and serves to position the housing 20 in the connector, post 81 being received in aperture 23 of rear platform 28. After wires 7 are terminated by stuffer 18, the cover 110 with upper shield 100 fixed thereto is assembled, latch 113 being hooked under hood 90, the rearwall 114 flexing slightly until detents 115 snap into apertures 90. The flanges 103 are received against rearwall 71 of lower shield 68 and flanges 104 are received against sidewalls 69 thereof.

Figure 7:
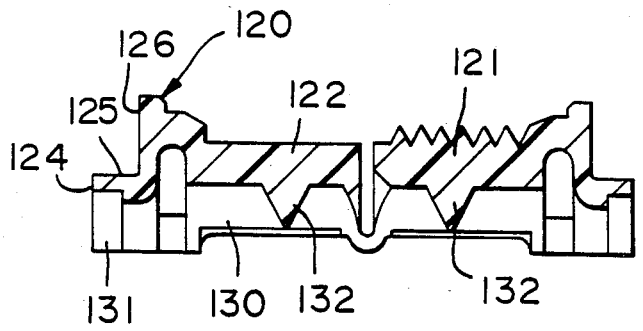
FIG. 7 is a side section view of the strain relief housing as molded.
Figure 4:
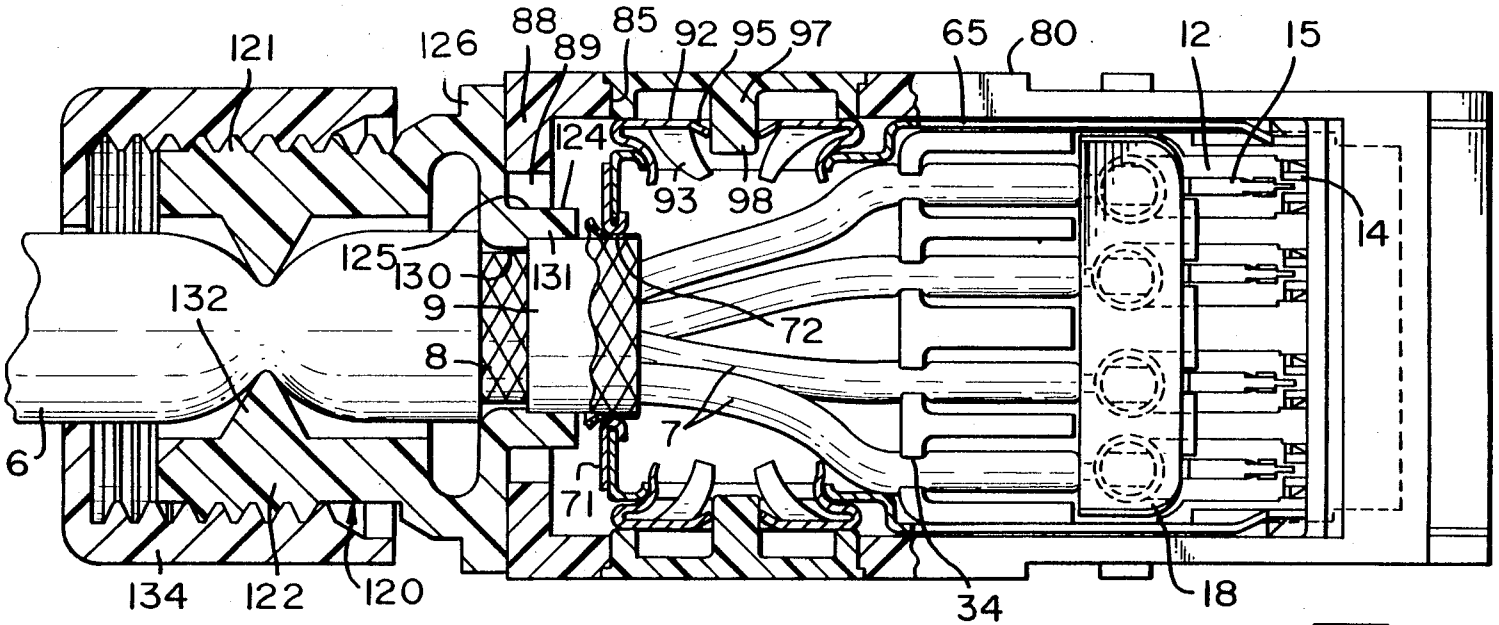
FIG. 4 is a partially sectioned plan view of the connector sans top cover.

FIG. 4 is a partially sectioned plan view, upper cover removed, showing the strain relief 120 and connection between braided shield 8 and lower shield 65 to best advantage. The inner square flange 124 is separated from outer square flange 126 by a cylindrical section 125 which permits rotation in aperture 89 of lower cover 80; the section is taken through laterally opposed corners of aperture 89 so that the retaining corners of flange 124 against rearwall 80 do not appear. Metal ferrule 9 is seated in counterbore 131 of bore 130 in strain relief ferrule 120; the braid 8 is dressed against ferrule 9 to make direct contact with lower shield 65. Note that only ferrule half 121 is threaded; half 122 is not threaded. It has been found that internally threaded outer ferrule 134 works just as well without full threading on ferrule 120, thus eliminating a minor alignment problem between halves 121, 122. Referring briefly to FIG. 7, the ferrule 120 is depicted as molded; the halves 121, 122 are swung so that protrusions 132 grip the cable 6, the ferrule 134 is threaded home, and the assembly is applied to the rear of the connector as previously described.

Referring to FIGS. 8, 8A and 8B, the ferrule 9 is generally tubular and has a seam 107 which permits radial compression thereof. The seam 107 comprises a first surface 108 and a generally parallel second surface 109, which surface are cut at about 45 degrees to the circumferential tangent they intersect. FIG. 8A is a partial end view of the ferrule 9 as manufactured, in the unstressed state. The surfaces 108, 109 are in contact and overlap as shown, the sharp edges being most proximate, whereby the braid cannot be caught in seam 107 when dressed. FIG. 8B shows the ferrule in the radially compressed state, as it would be in FIG. 4. The surfaces 108, 109 have slid against each other to overlap with the dull edges most proximate, the effective diameter of the ferrule being decreased. The ferrule 9 so compressed exerts a uniform radial force on the braid 8 trapped between the ferrule 9 and shield 65 (FIG. 4).

FIG. 4 also depicts to good advantage the cooperation of shield plug 92 and cover plug 97; the outer fingers 93 engage shield 65 and the inner fingers 95 engage post 98 to hold dielectric plug 97 in cover 80.

FIGS. 5 and 6 depict the operation of two identical hermaphroditic connectors 2, 2' as heretofore described, with primed reference numerals being assigned to the second connector 2'. Referring to FIG. 5, the connectors 2, 2' are shown prior to mating. The resilient tongues 14, 14' are in their undeformed state poised above stops 26, 26', which pass through slots 13, 13' in respective base portions 12, 12' of terminals 10, 10'. The resilient lugs 59, 63, 59', 63' are disposed against respective tails 16, 16' to electrically connect pairs of alternate terminals 10, 10' in respective connectors together; this connection is maintained by the resilient biasing of springs 54, 54' against respective rearwalls 37, 37' in chambers 35, 35'. The actuators 51, 51' protrude through walls 36, 36' below terminal support platforms 21, 21'.

FIG. 6 shows the connector 2, 2' in mated condition; latches 118, 83' and 83, 118' have been flexed to engage in straightforward fashion, the male and female T-profiles thereon being mated. The resilient tongues 14 are resiliently disposed against respective tongues 14', a good wiping action being achieved during this engagement. The forward contact tongue 102 on upper shield 100 is against the forward contact portion 68' of lower shield 65' in connector 2', and likewise the forward portion 68 is against the upper portion 102'. Most importantly, actuator 51 is borne against by the forward end of hood 91' to disengage the contact lugs 59, 63 from tails 16, whereby all terminals 10 are electrically independent of each other. The spring 54 is further compressed in chamber 37, and thus will return the carrier 42 to again shunt pairs of alternate terminals 10. Likewise, actuator 51' is borne against by the forward end of hood 91 to similarly disconnect the shunt means in connector 2' from terminals 10' therein. Note that the angular dependence of lugs 59, 63 from respective bridges 57, 61 causes a vertical shift of the contact points with respective tails 16 during engagement or disengagement, thus yielding a desirable wiping action to assure good electrical connection between shunted terminals when the connectors are disengaged.

The foregoing is exemplary and not intended to limit the scope of the claims which follow.

We claim:

1. A hermaphroditic electrical connector of the type comprising an insulating housing having a plurality of conductive terminals and electrical shunt means therein, said terminals having resilient contact tongues which engage like tongues in a like connector, said shunt means being in shunted relation with said terminals when said connector is in an unmated condition, said shunt means being in unshunted relation with said terminals when said connector is in mating engagement with a complementary connector, characterized in that said shunt means are fixed to a dielectric carrier which moves relative to said housing in response to mating with a complementary hermaphroditic connector, said shunt means engaging portions of said terminals remote from said contact tongues, whereby said shunt means moves relative to said housing and out of shunted relation with said terminal portions.

2. An electrical connector as in claim 1 characterized in that said carrier is borne against by the complementary connector to move the shunt means from the shunted to the unshunted condition during mating.

3. An electrical connector as in claim 1 characterized in that said connector further comprises resilient biasing means which bears against said carrier to move said shunt means to shunted relation during unmating.

4. An electrical connector as in claim 1 characterized in that said connector has a mating face profiled to engage with the mating face of a like connector, the portions of said terminals engaged by said shunt means being fixed relative to the housing and isolated from the mating face, the shunt means likewise being isolated from the mating face, the carrier having an actuator portion which extends to the mating face where said actuator is borne against by said complementary connector during mating.

5. An electrical connector as in claim 1 characterized in that the resilient tongues are disposed over stops in the housing, said stops being positioned to prevent overstress of said tongues.

6. An electrical connector as in claim 1 characterized in that the shunt means comprises two one-piece shunt bars fixed to said carrier in spaced-apart relation, each having a bridge portion which extends transversely of at least three terminals and a pair of spaced contact lugs extending from each bridge portion toward respective preselected terminals.

7. An electrical connector as in claim 6 characterized in that the contact lugs are disposed freely toward said terminals at an oblique angle thereto, said lugs undergoing resilient deformation relative to the shunt bars when in contact with the terminals in an unmated condition of the connector.

8. A hermaphroditic electrical connector of the type comprising an insulating housing having a plurality of conductive terminals and electrical shunt means therein, said terminals having resilient contact tongues which engage like tongues in a like connector, said shunt means being in shunted relation with said terminals when said connector is in an unmated condition, said shunt means being in unshunted relation with said terminals when said connector is in mating engagement with a complementary connector, characterized in that said shunt means are movable relative to said housing into and out of engagement with said terminals in response to mating with a complementary hermaphroditic connector, said shunt means comprising resiliently deformable means disposed at an oblique angle relative to said terminals and engaging said terminals remote from said contact tongues, whereby said shunt means moves relative to said housing and out of shunted relation with said terminal portions.

* * * * *